US009593586B2

(12) United States Patent
Clark

(10) Patent No.: US 9,593,586 B2
(45) Date of Patent: Mar. 14, 2017

(54) VANE ASSEMBLY AND METHOD OF MAKING THE SAME

(71) Applicant: ROLLS-ROYCE PLC, London (GB)

(72) Inventor: Brynley Clark, South Glos (GB)

(73) Assignee: ROLLS-ROYCE plc, London (GB)

( * ) Notice: Subject to any disclaimer, the term of this patent is extended or adjusted under 35 U.S.C. 154(b) by 445 days.

(21) Appl. No.: 14/197,795

(22) Filed: Mar. 5, 2014

(65) Prior Publication Data

US 2014/0301836 A1 Oct. 9, 2014

(30) Foreign Application Priority Data

Apr. 5, 2013 (GB) ..... 1306123.9

(51) Int. Cl.
*F01D 9/04* (2006.01)
*F01D 5/28* (2006.01)

(52) U.S. Cl.
CPC ..... *F01D 9/042* (2013.01); *F01D 5/28* (2013.01); *Y10T 29/49321* (2015.01)

(58) Field of Classification Search
None
See application file for complete search history.

(56) References Cited

U.S. PATENT DOCUMENTS 3,339,833 A 9/1967 Bill et al.
3,536,414 A 10/1970 Smith
4,594,761 A * 6/1986 Murphy ..... B23P 15/04 29/418
5,074,752 A * 12/1991 Murphy ..... F01D 9/042 415/119
5,083,900 A 1/1992 Carletti et al.
6,024,536 A 2/2000 Tsubakida et al.
7,648,334 B2 * 1/2010 Hurst ..... F01D 5/141 29/889.2

FOREIGN PATENT DOCUMENTS

EP 1 219 785 A1 7/2002
EP 1 493 901 A1 1/2005
EP 1 847 681 A3 10/2007
EP 1 905 959 A2 4/2008
(Continued)

OTHER PUBLICATIONS

European Search Report issued in European Application No. 14 15 7795 issued May 23, 2014.
(Continued)

*Primary Examiner* — Nathaniel Wiehe
*Assistant Examiner* — Jason Davis
(74) *Attorney, Agent, or Firm* — Oliff PLC

(57) ABSTRACT

A vane assembly for a gas turbine engine comprises at least one vane, a first platform and a second platform. The at least one vane has a first end and an opposite second end with the first end of the at least one vane being secured in a corresponding first aperture in the first platform, and the second end of the at least one vane being secured in a corresponding second aperture in the second platform.
The at least one vane intersects the first platform at an acute angle, and the at least one vane intersects the second platform at an obtuse angle with the acute angle and the obtuse angle being supplementary to one another.

18 Claims, 4 Drawing Sheets

(56) References Cited

FOREIGN PATENT DOCUMENTS

| | | | |
|---|---|---|---|
| EP | 1 911 931 | A2 | 4/2008 |
| EP | 2 169 182 | A2 | 3/2010 |
| EP | 2 568 120 | A2 | 3/2013 |
| GB | 749577 | | 5/1956 |
| GB | 2 266 931 | A | 11/1993 |
| WO | WO 2014/037675 | A1 | 3/2014 |

OTHER PUBLICATIONS

Oct. 8, 2013 British Search Report issued in British Application No. 1306123.9.

* cited by examiner

VANE ASSEMBLY AND METHOD OF MAKING THE SAME

This invention claims the benefit of UK Patent Application No. 1306123.9, filed on 5 Apr. 2013, which is hereby incorporated herein in its entirety.

FIELD OF THE INVENTION

The present invention relates to a vane assembly and particularly, but not exclusively, to a vane assembly for a fan for use in a gas turbine engine, together with a method for making such a vane assembly.

BACKGROUND TO THE INVENTION

A gas turbine engine may be fitted with a fan assembly at its intake to thus form a turbofan or fanjet engine. In such an arrangement, the fan is driven by the gas turbine engine and provides compressed air flow to the gas turbine engine, together with a bypass air flow that provides additional thrust.

In other configurations the gas turbine engine may drive a secondary fan assembly via a driveshaft. This secondary fan assembly may then be used to provide a regulated separate airflow to that passing through the gas turbine engine.

In either of the aforementioned arrangements, the fan assembly comprises a rotational array of fan blades disposed around a hub. Typically several fan assemblies are positions in series with one another with a static interstage vane array being interposed therebetween.

The static interstage vane array redirects the air exiting one fan stage so as to be optimally directed towards the following fan array. The interstage vanes typically each comprise a radially oriented centre aerofoil portion having radially inner and outer platforms.

One example of such a typical vane array arrangement is shown in FIG. 1 in which the aerofoil together with the inner and outer platforms is integrally moulded. The mouldings are then assembled into an engine casing as a circumferential array.

One problem with the prior art arrangement of FIG. 1 is that the complexity of the tooling required to integrally mould the vane makes the process expensive.

A further such problem is that the fillet radius at the junction of the aerofoil portion and each of the inner and outer platforms, which is important to the efficient operation of the vane array, is difficult to produce consistently.

In addition, the moulded vane structure has little intrinsic damping. This requires the vane array to be provided with additional componentry to prevent the high vibration levels caused by operation of the gas turbine engine causing high cycle fatigue of the component. One example of such a solution is the use of damping foil on the vane surfaces to provide damping and so increase fatigue resistance.

STATEMENTS OF INVENTION

According to a first aspect of the present invention there is provided a vane assembly for a gas turbine engine, comprising:

at least one vane, the or each at least one vane having a first end and an opposite second end;

a first platform; and a second platform;

whereby the first end of the or each at least one vane is secured in a corresponding first aperture in the first platform, and the second end of the or each at least one vane is secured in a corresponding second aperture in the second platform, and wherein the or each at least one vane intersects the first platform at an acute angle and the or each at least one vane intersects the second platform at an obtuse angle, the acute angle and the obtuse angle being supplementary.

The manufacture of unshrouded vanes (i.e. vanes without integral end platforms) is simpler and requires less expensive tooling than for shrouded vanes.

Furthermore, by not integrally moulding the aerofoil portion with the end platforms, the problem of maintaining a consistent fillet radius between these components is eliminated.

In the present invention, the fillet radius at the junction between the vane and the corresponding platform can be produced as part of the process of securing the vane to each of the platforms. Since this process is separate from that forming the vane itself, it can be more readily controlled in order to maintain this critically important parameter within predetermined limits.

Optionally, the first platform and second platform are formed as concentric arcs.

In one arrangement the platforms are formed as concentric arcs in which the radius of curvature is such that when a plurality of the vane assemblies are positioned in a circumferential array they form a circular vane array. This makes the vane array more aerodynamically efficient than a corresponding array having linear platforms.

Optionally, the first platform is circumferentially offset from the second platform.

By circumferentially offsetting the first and second platforms from one another, the angled, or skewed, vane may be accommodated in a mid-portion of the respective platform. This makes the joints between the first and second ends of the vane and the respective platform more robust and therefore able to maintain the aerodynamic geometry of the vane assembly.

Optionally, the first and second ends of the or each at least one vane are adhesively secured to corresponding first and second apertures by an adhesive compound.

The use of an adhesive compound makes the manufacture of the vane assembly simpler and easier, and therefore cheaper than the prior art techniques of integrally moulding the vane and platforms.

Optionally, the adhesive compound is an elastomeric compound.

The use of a rubber-based adhesive compound provides a measure of damping to the vane assembly. This enables the vane assembly and any vane array to which it is a component part to better withstand the high frequency vibration generated by operation of the gas turbine engine. This eliminates the need to add additional componentry to or carry out additional surface treatment on the vane assembly to enable it to be able to operate reliably in the gas turbine engine.

The use of an elastomeric compound to secure the vane to the platforms provides a level of intrinsic damping to the vane assembly. This eliminates the need for additional componentry, or manufacturing or surface treatments to the vane assembly in order to enable the vane assembly to withstand the vibration levels to which it is exposed during the operation of the gas turbine engine.

This makes the vane assembly of the present invention cheaper and simpler to manufacture and so more convenient for a user.

Optionally, the or each at least one vane is formed from a metal or a metal alloy.

In prior art arrangements, the integrally moulded vane assemblies are not usually made from metals or metal alloys because these materials are susceptible to fatigue loading resulting from the high frequency vibration generated by the operation of the gas turbine engine.

In the present invention, the presence of the adhesive compound securing the vane to the first and second platforms provides inherently high levels of damping and hence resistance to vibration induced fatigue loading. In this way, the vane may be formed from a metal or metal alloy which provides a significantly higher level of temperature resistance than composite materials.

Optionally, the or each at least one vane is formed from a fibre reinforced composite material.

The use of fibre reinforced materials to form the vane provides a significant weight advantage over the use of a metal or metal alloy for the same purpose.

Optionally, at least one of the first platform and second platform is formed from a metal or a metal alloy.

As mentioned above, the use of a metal or metal alloy can provide significant high temperature capabilities relative to the use of composite materials.

Optionally, at least one of the first platform and second platform is formed from a fibre reinforced composite material.

As mentioned above, the use of a composite material can provide a significant weight advantage relative to the use of a metal or metal alloy.

Optionally, an end portion of each of the first and second ends of the or each at least one vane is tapered outwardly towards the respective first and second ends, thereby defining a first included taper angle.

This provides an increased area at each of the first and second ends of the vane over which an axial load can be spread. This in turn reduces the possibility of the vane being pulled out of either of the first and second platform. This makes the vane assembly of the present invention robust and reliable and therefore more user friendly.

Optionally, each of the first and second apertures tapers outwardly through a thickness of the corresponding first and second platform in a direction extending towards respective first and second ends of the or each at least one vane, thereby defining a second included taper angle.

In one arrangement, the first and second apertures in the corresponding first and second platforms are tapered at the same included taper angle as that of the first and second ends of the or each at least one vane. In other words, the first included taper angle is the same as the second included taper angle.

In this arrangement, when the void defined between the first and second ends of the vane and the corresponding aperture is filled with the adhesive compound, an axial load on the vane results in a mixed stress regime in the adhesive compound.

The presence of the tapered surfaces means that the forces on the adhesive compound are not entirely dependent upon the shear strength of the adhesive compound. Rather the adhesive compound is subjected to a stress regime comprising a mixture of compressive loading and shear loading.

Since the adhesive compound is significantly more resistant to compressive loading than shear loading, this makes the joint arrangement of the present invention significantly stronger than a conventional joint having straight-sided aperture in which the loading on the adhesive compound is entirely shear dependent.

Optionally, a maximum width of each of the first and second ends of the or each at least one vane is less than a minimum width of the corresponding first and second apertures in respective first and second platforms.

This enables the first and second ends of the vane to be inserted into corresponding first and second apertures in respective first and second platforms prior to the adhesive compound being inserted into the void defined therebetween. This simplifies the manufacture the vane assembly of the present invention thus making it cheaper to manufacture than an integrally moulded vane assembly.

Optionally, either of the first included taper angle and the second included taper angle, is in the range of 15° to 40°.

Optionally, either of the first included taper angle and the second included taper angle, is in the range of 20° to 35°.

According to a second aspect of the present invention there is provided a method of manufacturing a vane assembly, comprising at least one vane, the or each at least one vane having a first end and an opposite second end the method comprising the steps of:

a. inserting the first end of the or each at least one vane into a corresponding first aperture in a first platform to thereby define a first void between a first end portion of the or each at least one vane and the corresponding first aperture;
b. positioning the first end of the or each at least one vane within the corresponding first aperture such that the or each at least one vane intersects the first platform at an acute angle;
c. filling the first void with a potting compound to thereby secure the first end of the or each at least one vane in the corresponding first aperture;
d. inserting the second end of the or each at least one vane into a corresponding second aperture in a second platform to thereby define a second void between a second end portion of the or each at least one vane and the corresponding second aperture;
e. positioning the second end of the or each at least one vane within the corresponding second aperture such that the or each at least one vane intersects the second platform at an obtuse angle, the acute angle and the obtuse angle being supplementary; and
f. filling the second void with a potting compound to thereby secure the second end of the or each at least one vane in the corresponding second aperture.

Optionally, the first platform and second platform are formed as concentric arcs.

Optionally, the first platform is circumferentially offset from the second platform.

According to a third aspect of the present invention there is provided a gas turbine engine interstage vane array comprising a plurality of vane assemblies according to the first or second aspects of the invention, arranged as a rotational array.

Other aspects of the invention provide devices, methods and systems which include and/or implement some or all of the actions described herein. The illustrative aspects of the invention are designed to solve one or more of the problems herein described and/or one or more other problems not discussed.

BRIEF DESCRIPTION OF THE DRAWINGS

There now follows a description of an embodiment of the invention, by way of non-limiting example, with reference being made to the accompanying drawings in which.

It is noted that the drawings may not be to scale. The drawings are intended to depict only typical aspects of the invention, and therefore should not be considered as limiting the scope of the invention. In the drawings, like numbering represents like elements between the drawings.

DETAILED DESCRIPTION

Figure 1:
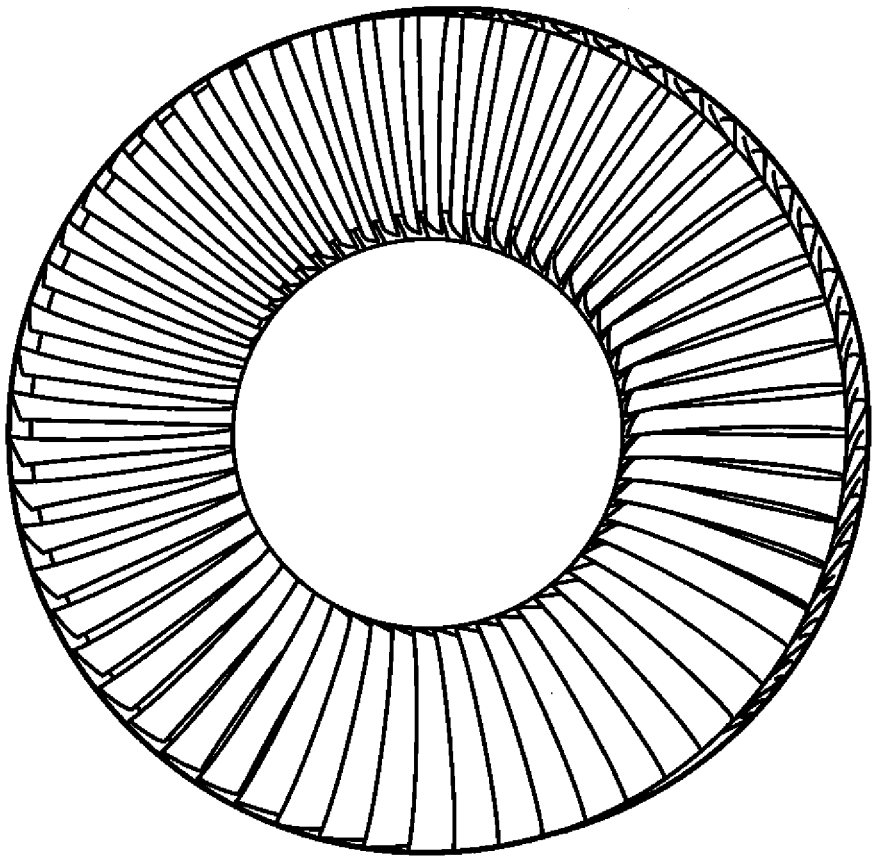
FIG. 1 (Prior Art)
FIG. 1 shows an axial view of a vane array according to the prior art.
Figure 2:
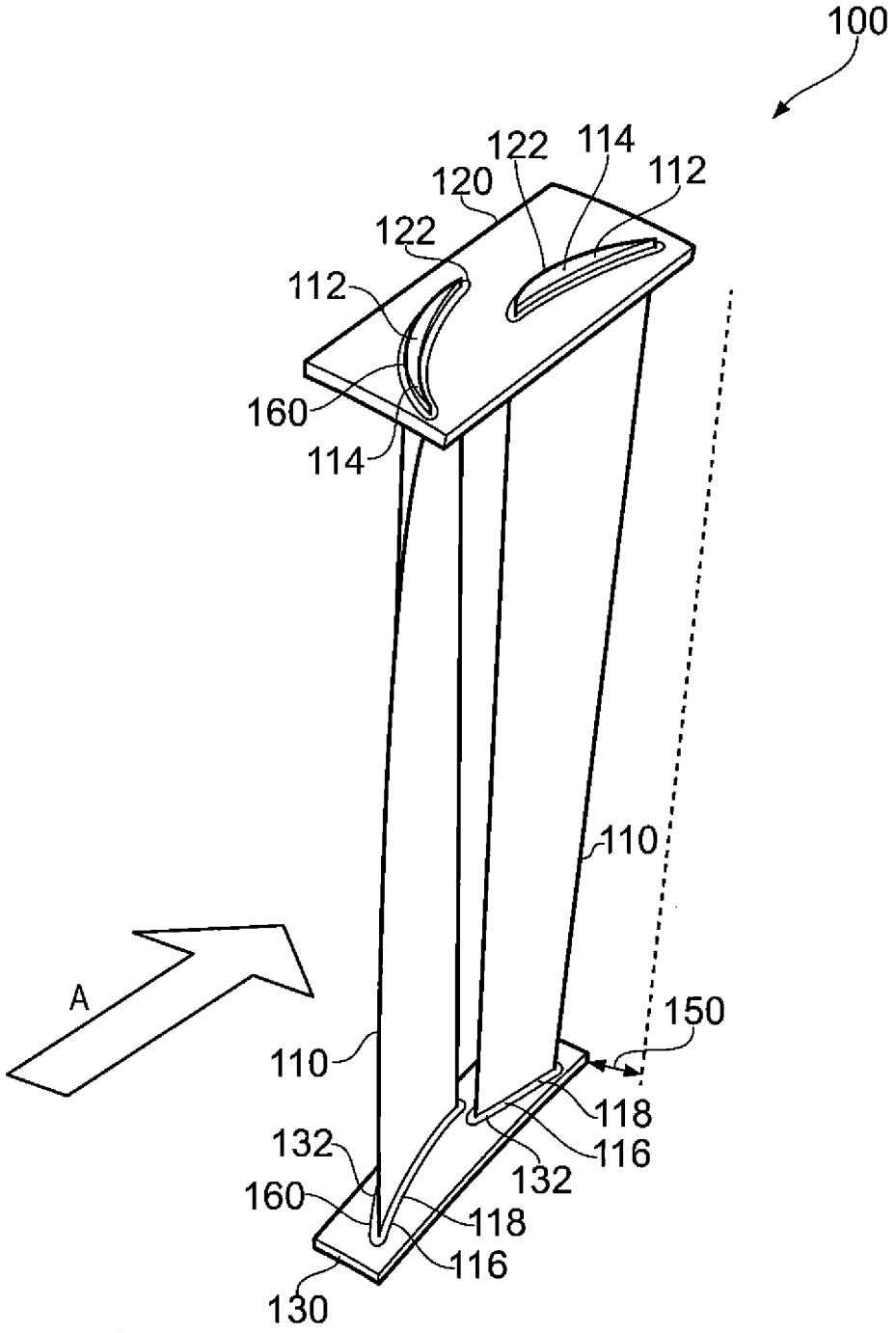
FIG. 2 shows a perspective view of a vane assembly according to an embodiment of the present invention.
Figure 3:
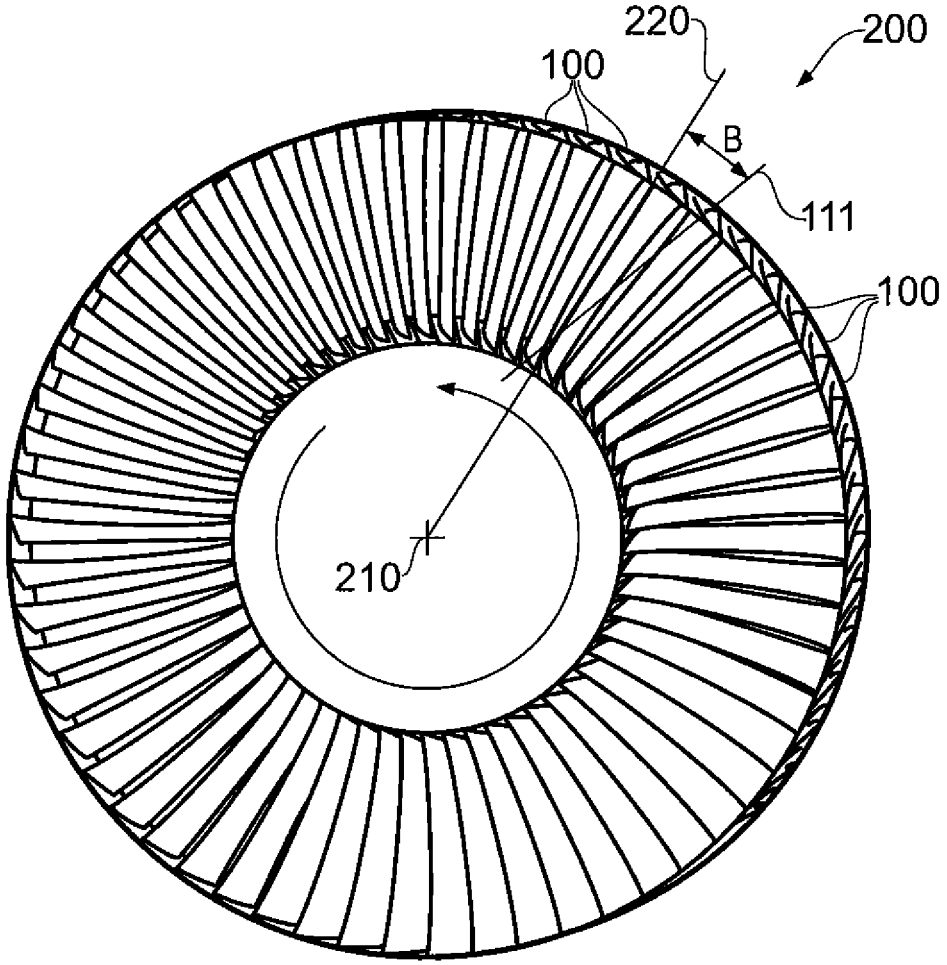
FIG. 3 shows an axial view of a vane array comprising a plurality of the vane assemblies of FIG. 2.
Figure 4:
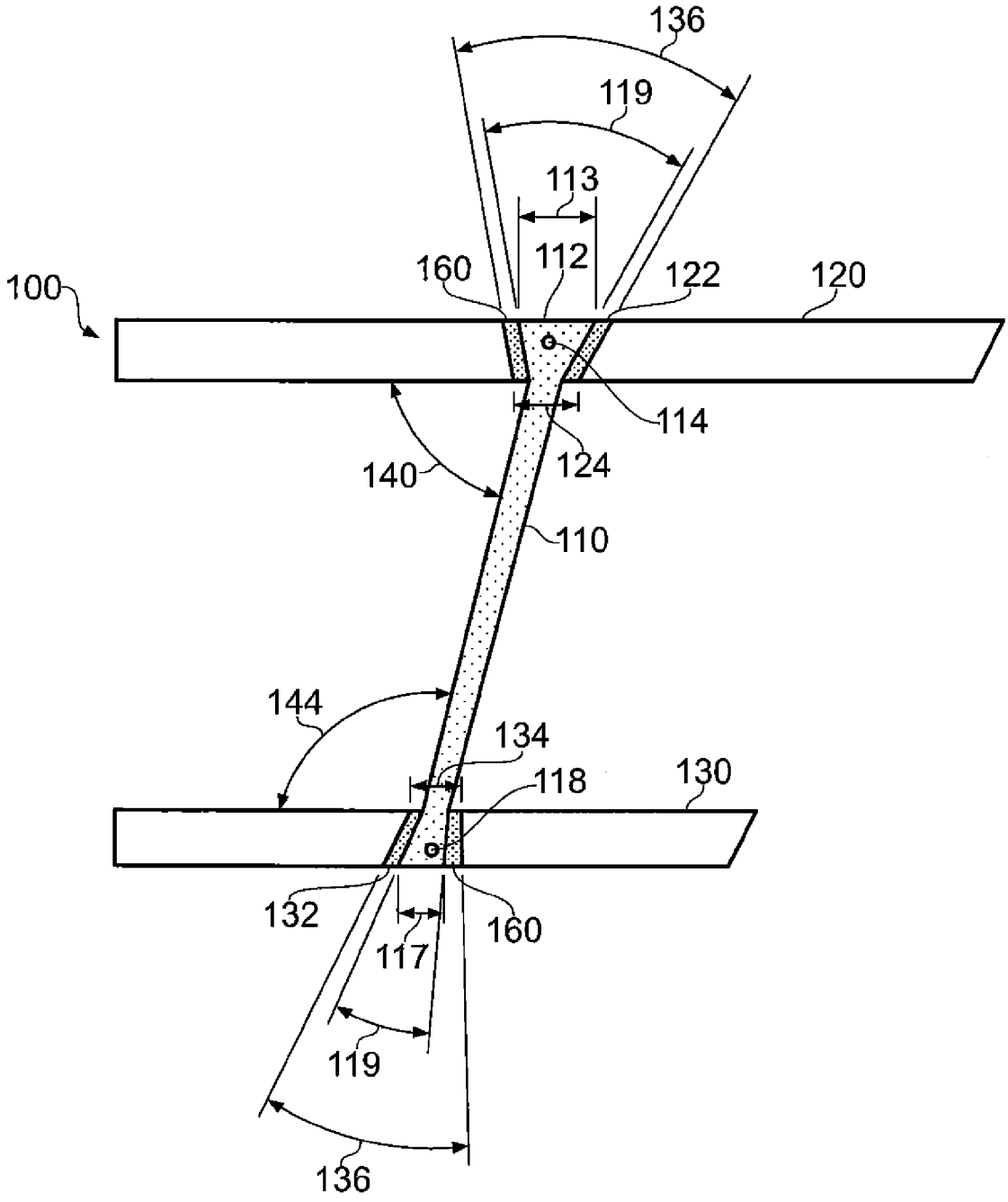
FIG. 4 shows a schematic sectional view through the vane assembly of FIG. 2.

Referring to FIGS. 2 to 4, a vane assembly according to an embodiment of the invention is designated generally by the reference numeral 100.

The vane assembly 100 comprises two vanes 110, a first platform 120 and a second platform 130.

Each of the vanes 110 are formed from carbon fibre reinforced composite material. The first platform 120 and the second platform 130 are formed as titanium alloy forgings.

Each of the two vanes 110 has a first end 112 and a second end 116. The first end 112 of each of the vanes 110 is secured in a corresponding first aperture 122 in the first platform 120. Similarly, the second end 116 of each of the vanes 110 is secured in a corresponding second aperture 132 in the second platform 130.

Since the vane assembly 100 forms part of a vane array 200 (shown in FIG. 3) the orientation of the two vanes 110 in the first and second platforms 120,130 is determined by the need for the vane array 200 to turn an airflow (not shown) passing across it.

Each of the two vanes 110 intersects the first platform 120 at an acute angle 140, and intersects the second platform 130 at an obtuse angle 144. The acute angle 140 and the obtuse angle 144 are supplementary to one another. In other words, the acute angle 140 and the obtuse angle 144 sum to 180°.

The effect of this angled or skewed orientation of the vane assemblies 100 is that an axis of the vane assemblies 100 is skewed at an angle 'B' relative to a radially extending datum on the vane array 200, as shown in FIG. 3. This skew is in the same circumferential direction as the tangential loading which results from gas flow through the vane array 200.

This skewed orientation of the vane assemblies 100 are therefore skewed in the unloaded condition in the same direction as that caused by the gas loading of the flow through the engine. This therefore results in a stiffer vane array 200 than one with unskewed and radially extending vane assemblies. The vane array 200 is thus resistant to further skewing caused by the gas loading.

The first platform 120 and the second platform 130 are formed as concentric arc. In other words, the first platform 120 and the second platform 130 are curved when viewed in the direction of arrow 'A' (see FIG. 2) which direction corresponds to the axis 210 of the vane array 200 shown in FIG. 3.

Each of the first ends 112 and second ends 116 of the two vanes 110 are secured in the corresponding first apertures 122 and second apertures 132 of the respective first and second platforms 120,130 by an adhesive compound 160.

In the present embodiment the adhesive compound 160 is a rubber-based compound that provides a combination of adhesion and damping.

As shown in FIG. 4, each of the first end portion 114 and the second end portion 118 respectively, of the first and second ends 112,116 of the vanes 110, taper outwardly towards the respective first and second ends 112,116.

The first and second end portions 114,118 each define a first included taper angle 119. In the present embodiment the first included taper angle 119 is 30°.

In addition, each of the first and second apertures 122,132 is formed as a tapered hole extending through the thickness of the respective first and second platforms 120,130 thereby defining a second included taper angle 136.

The first included taper angle 119 and the second included taper angle 136 correspond to one another and are spaced apart from one another to thereby define a void therebetween which is to be filled with the adhesive compound 160.

A maximum width 113, 117 of the first and second ends 112,116 of the vanes is lesser less than the minimum width 124,134 of the first and second apertures 120,130. In this way the first and second ends 112,116 of the vanes 110 can readily be inserted into the corresponding first and second apertures 122,132 of the first and second platforms 120,130 during manufacture of the vane assemblies 100.

The foregoing description of various aspects of the invention has been presented for purposes of illustration and description. It is not intended to be exhaustive or to limit the invention to the precise form disclosed, and obviously, many modifications and variations are possible. Such modifications and variations that may be apparent to a person of skill in the art are included within the scope of the invention as defined by the accompanying claims.

What is claimed is:

1. A vane assembly for a gas turbine engine, comprising:

at least one vane, the or each at least one vane having a first end and an opposite second end;

a first platform; and a second platform, wherein:

the first end of the or each at least one vane is secured in a corresponding first aperture in the first platform;

the second end of the or each at least one vane is secured in a corresponding second aperture in the second platform;

the or each at least one vane intersects the first platform at an acute angle, and the or each at least one vane intersects the second platform at an obtuse angle, the acute angle and the obtuse angle being substantially supplementary;

an end portion of each of the first and second ends of the or each at least one vane is tapered outwardly towards the respective first and second ends, thereby defining a first included taper angle; and a maximum width of each of the first and second ends of the or each at least one vane is less than a minimum width of the corresponding first and second apertures in respective first and second platforms.

2. The vane assembly as claimed in claim 1, wherein the first platform and second platform are formed as concentric arcs.

3. The vane assembly as claimed in claim 2, wherein the first platform is circumferentially offset from the second platform.

4. The vane assembly as claimed in claim 1, wherein the first and second ends of the or each at least one vane are adhesively secured to corresponding first and second apertures by an adhesive compound.

5. The vane assembly as claimed in claim 4, wherein the adhesive compound is an elastomeric compound.

6. The vane assembly as claimed in claim 1, wherein the or each at least one vane is formed from a metal or a metal alloy.

7. The vane assembly as claimed in claim 1, wherein the or each at least one vane is formed from a fibre reinforced composite material.

8. The vane assembly as claimed in claim 1, wherein at least one of the first platform and second platform is formed from a metal or a metal alloy.

9. The vane assembly as claimed in claim 1, wherein at least one of the first platform and second platform is formed from a fibre reinforced composite material.

10. The vane assembly as claimed in claim 1, wherein each of the first and second apertures tapers outwardly through a thickness of the corresponding first and second platform in a direction extending towards respective first and second ends of the or each at least one vane, thereby defining a second included taper angle.

11. The vane assembly as claimed in claim 10, wherein either of the first included taper angle and the second included taper angle, is in the range of 15° to 40°.

12. The vane assembly as claimed in claim 11, wherein either of the first included taper angle and the second included taper angle, is in the range of 20° to 35°.

13. A gas turbine engine fan assembly comprising a plurality of vane assemblies according to claim 1, arranged as a rotational array.

14. The vane assembly as claimed in claim 1, wherein an adhesive compound fills a void within each of the first and second apertures to secure the first and second ends of the or each at least one vane to the respective first and second platforms.

15. A method of manufacturing a vane assembly, comprising at least one vane, the or each at least one vane having a first end and an opposite second end, the method comprising the steps of:

a. inserting the first end of the or each at least one vane into a corresponding first aperture in a first platform to thereby define a first void between a first end portion of the or each at least one vane and the corresponding first aperture;

b. positioning the first end of the or each at least one vane within the corresponding first aperture such that the or each at least one vane intersects the first platform at an acute angle;

c. filling the first void with a potting compound to thereby secure the first end of the or each at least one vane in the corresponding first aperture;

d. inserting the second end of the or each at least one vane into a corresponding second aperture in a second platform to thereby define a second void between a second end portion of the or each at least one vane and the corresponding second aperture;

e. positioning the second end of the or each at least one vane within the corresponding second aperture such that the or each at least one vane intersects the second platform at an obtuse angle, the acute angle and the obtuse angle being substantially supplementary; and f. filling the second void with a potting compound to thereby secure the second end of the or each at least one vane in the corresponding second aperture, wherein:

an end portion of each of the first and second ends of the or each at least one vane is tapered outwardly towards the respective first and second ends, thereby defining a first included taper angle; and a maximum width of each of the first and second ends of the or each at least one vane is less than a minimum width of the corresponding first and second apertures in respective first and second platforms.

16. The method as claimed in claim 15, wherein the first platform and second platform are formed as concentric arcs.

17. The method as claimed in claim 16, wherein the first platform is circumferentially offset from the second platform.

18. The method as claimed in claim 15, wherein the first and second ends of the or each at least one vane are radially inserted into the corresponding first and second apertures.

* * * * *